US009435168B2

(12) United States Patent
Trinh

(10) Patent No.: US 9,435,168 B2
(45) Date of Patent: Sep. 6, 2016

(54) DOWNHOLE ACTIVATION ASSEMBLY AND METHOD OF USING SAME

(71) Applicant: National Oilwell DHT, L.P., Houston, TX (US)

(72) Inventor: Khoi Trinh, Spring, TX (US)

(73) Assignee: National Oilwell DHT, L.P., Houston, TX (US)

( * ) Notice: Subject to any disclaimer, the term of this patent is extended or adjusted under 35 U.S.C. 154(b) by 290 days.

(21) Appl. No.: 14/165,202

(22) Filed: Jan. 27, 2014

(65) Prior Publication Data

US 2014/0216761 A1 Aug. 7, 2014

Related U.S. Application Data

(60) Provisional application No. 61/760,120, filed on Feb. 3, 2013.

(51) Int. Cl.
*E21B 23/04* (2006.01)
*E21B 10/32* (2006.01)

(52) U.S. Cl.
CPC ..... *E21B 23/04* (2013.01); *E21B 10/322* (2013.01)

(58) Field of Classification Search
CPC ..... E21B 23/004; E21B 34/14; E21B 23/04
See application file for complete search history.

(56) References Cited

U.S. PATENT DOCUMENTS 5,960,881 A 10/1999 Allamon et al.
6,615,933 B1 9/2003 Eddison
7,252,163 B2 8/2007 Ollerenshaw et al.
7,308,937 B2 12/2007 Radford et al.
7,469,744 B2 12/2008 Ruddock et al.
7,503,392 B2 3/2009 King et al.
7,681,650 B2 3/2010 Telfer et al.
7,703,553 B2 4/2010 Eddison et al.
7,823,663 B2 11/2010 Eddison
8,074,747 B2 12/2011 Radford et al.
8,181,722 B2 5/2012 Radford et al.
8,215,418 B2 7/2012 Radford
8,230,951 B2 7/2012 Radford et al.
(Continued)

FOREIGN PATENT DOCUMENTS

WO 2010088231 8/2010

OTHER PUBLICATIONS

Canadian Office Action dated Mar. 31, 2015 for counterpart Canadian Application No. 2,840,855, 3 pages.

*Primary Examiner* — William P Neuder
(74) *Attorney, Agent, or Firm* — Conley Rose, P.C.

(57) ABSTRACT

A downhole activation assembly for activating a downhole component of a downhole tool positionable in a wellbore penetrating a subterranean formation. The activation assembly includes a housing operatively connectable to the downhole tool, a spring-loaded sleeve, and a ball catcher. The sleeve slidably positionable in the housing, and having a flow channel therethrough and an outer surface defining a chamber between the sleeve and the housing. The sleeve having inlets therethrough about a sleeve end thereof to permit fluid from the flow channel to pass therethrough. The ball catcher slidably positionable in the housing, and having a catcher end engageable with the sleeve end to selectively divert the fluid thereabout and a ball seat therein to receivingly engage a ball passing through the sleeve whereby the ball catcher selectively moves the downhole component between activation positions.

20 Claims, 7 Drawing Sheets

(56) References Cited

U.S. PATENT DOCUMENTS

| | | | | |
|---|---|---|---|---|
| 8,936,110 | B2 | 1/2015 | Adam | |
| 2008/0128169 | A1 | 6/2008 | Radford et al. | |
| 2008/0128174 | A1 | 6/2008 | Radford et al. | |
| 2009/0025927 | A1* | 1/2009 | Telfer | E21B 21/103 166/174 |
| 2010/0212969 | A1 | 8/2010 | Radford et al. | |
| 2010/0212970 | A1 | 8/2010 | Radford et al. | |
| 2010/0252276 | A1* | 10/2010 | Clausen | E21B 23/006 166/381 |
| 2011/0073376 | A1 | 3/2011 | Radford et al. | |
| 2011/0127044 | A1 | 6/2011 | Radford et al. | |
| 2011/0192607 | A1 | 8/2011 | Hofman et al. | |
| 2012/0055714 | A1* | 3/2012 | Adam | E21B 41/00 175/57 |
| 2012/0073828 | A1* | 3/2012 | Churchill | E21B 23/00 166/373 |
| 2012/0080183 | A1 | 4/2012 | Radford et al. | |
| 2012/0080228 | A1 | 4/2012 | Radford et al. | |
| 2012/0111579 | A1 | 5/2012 | Radford et al. | |
| 2013/0192897 | A1 | 8/2013 | MacKenzie et al. | |
| 2014/0216761 | A1 | 8/2014 | Trinh | |
| 2015/0027725 | A1 | 1/2015 | Adam | |
| 2015/0176355 | A1 | 6/2015 | Trinh et al. | |
| 2015/0191999 | A1 | 7/2015 | Adam | |

* cited by examiner

DOWNHOLE ACTIVATION ASSEMBLY AND METHOD OF USING SAME

CROSS-REFERENCE TO RELATED APPLICATIONS

This patent application claims priority to U.S. Provisional Application No. 61/760,120 filed on Feb. 3, 2013, the entire contents of which are hereby incorporated by reference herein.

BACKGROUND

This present disclosure relates generally to techniques for performing wellsite operations. More specifically, the present disclosure relates to techniques, such as activators or activation assemblies, for use with downhole tools.

Oilfield operations may be performed to locate and gather valuable downhole fluids. Oil rigs are positioned at wellsites, and downhole equipment, such as drilling tools, is deployed into the ground by a drill string to reach subsurface reservoirs. At the surface, an oil rig is provided to deploy stands of pipe into the wellbore to form the drill string. Various surface equipment, such as a top drive, or a Kelly and a rotating table, may be used to apply torque to the stands of pipe, threadedly connect the stands of pipe together, and to rotate the drill string. A drill bit is mounted on the lower end of the drill string, and advanced into the earth by the surface equipment to form a wellbore.

The drill string may be provided with various downhole components, such as a bottom hole assembly (BHA), drilling motor, measurement while drilling, logging while drilling, telemetry, reaming and other downhole tools, to perform various downhole operations. The downhole tool may be provided with devices for activation of downhole components. Examples of downhole tools are provided in U.S. Patent/Application Nos. 20080128174, 20110073376, 20100252276, 20110127044, U.S. Pat. Nos. 7,252,163, 8,215,418 and 8,230,951, the entire contents of which are hereby incorporated by reference herein.

SUMMARY

In at least one aspect, the disclosure relates to a downhole activation assembly for activating a downhole component of a downhole tool positionable in a wellbore penetrating a subterranean formation. The activation assembly includes a housing operatively connectable to the downhole tool, a spring-loaded sleeve, and a ball catcher. The sleeve slidably positionable in the housing, and having a flow channel therethrough and an outer surface defining a chamber between the sleeve and the housing. The sleeve having inlets therethrough about a sleeve end thereof to permit fluid from the flow channel to pass therethrough. The ball catcher slidably positionable in the housing, and having a catcher end engageable with the sleeve end to selectively divert the fluid thereabout and a ball seat therein to receivingly engage a ball passing through the sleeve whereby the ball catcher selectively moves the downhole component between activation positions.

The sleeve and the ball catcher may be positionable to prevent fluid flow between the flow channel and the chamber. The fluid may be passed through the ball catcher when the ball is unseated from the ball catcher. The fluid may be diverted between the ball catcher and the housing when the ball is seated in the ball catcher. The ball catcher may have paths therethrough to permit the fluid to flow to pass from between the housing and the ball catcher to the downhole component. The downhole component may have channels to pass fluid from the paths therethrough.

The activation assembly may also include seals positioned between the sleeve and the housing. The seals may include an uphole seal at an uphole end, a downhole seal at the sleeve end, and an intermediate seal between the uphole and the downhole seals. The activation assembly may also include a blade engageable by the outer surface of the sleeve and selectively extendable from the housing thereby. The outer surface may be tapered. The ball catcher may include an elastomeric material along an inner surface thereof engageable with the ball.

In another aspect, the disclosure relates to a downhole tool positionable in a wellbore penetrating a subterranean formation. The downhole tool includes a conveyance, a bottom hole assembly deployable into the wellbore by the conveyance and carrying a downhole component, and a downhole activation assembly positionable about the bottom hole assembly. The activation assembly includes a housing operatively connectable to the downhole tool, a spring-loaded sleeve, and a ball catcher. The sleeve slidably positionable in the housing, and having a flow channel therethrough and an outer surface defining a chamber between the sleeve and the housing. The sleeve having inlets therethrough about a sleeve end thereof to permit fluid from the flow channel to pass therethrough. The ball catcher slidably positionable in the housing, and having a catcher end engageable with the sleeve end to selectively divert the fluid thereabout and a ball seat therein to receivingly engage a ball passing through the sleeve whereby the ball catcher selectively moves the downhole component between activation positions.

The downhole component may be an indexer. The downhole tool may include a reamer with a blade. The sleeve may be engageable with the blade whereby the blade is selectively extendable therefrom. The downhole tool may also include a controller.

Finally, in another aspect, the disclosure relates to a method of activating a downhole component of a downhole tool positionable in a wellbore penetrating a subterranean formation. The method involves deploying an activation assembly into the wellbore via the downhole tool. The activation assembly includes a spring-loaded sleeve and a ball catcher slidably positionable in a housing. The sleeve has a flow channel therethrough and an outer surface defining a chamber between the sleeve and the housing, and has inlets therethrough about a sleeve end thereof to permit fluid from the flow channel to pass therethrough. The ball catcher has a catcher end and a ball seat therein. The method also involves selectively moving the downhole component between activation positions by deploying a ball through the sleeve and into the ball catcher and selectively engaging the sleeve end with the catcher end such that the fluid is selectively diverted about the ball catcher.

The selectively moving may involve diverting fluid through the ball catcher when the ball is unseated therein and/or diverting fluid between the ball catcher and the housing when the ball is seated therein. The method may also involve passing the fluid through paths in the ball catcher and channels in the downhole component and/or passing the fluid from the flow channel to the chamber via the inlets.

BRIEF DESCRIPTION OF THE DRAWINGS

The appended drawings illustrate example embodiments and are, therefore, not to be considered limiting of its scope.

The figures are not necessarily to scale and certain features, and certain views of the figures may be shown exaggerated in scale or in schematic in the interest of clarity and conciseness.

DETAILED DESCRIPTION OF THE INVENTION

The description that follows includes exemplary apparatus, methods, techniques, and/or instruction sequences that embody aspects of the present subject matter. However, it is understood that the described embodiments may be practiced without these specific details.

The present disclosure relates to an activation assembly for remotely activating a downhole tool, such as a reamer, from the surface. The activation assembly includes a ball deployable through the downhole tool and engageable with a downhole actuator. The ball may be used to selectively restrict the flow of fluid through the downhole tool and/or the activation assembly. Pressure changes in the downhole tool by the activation assembly may be manipulated to selectively activate the downhole tool.

Figure 1:
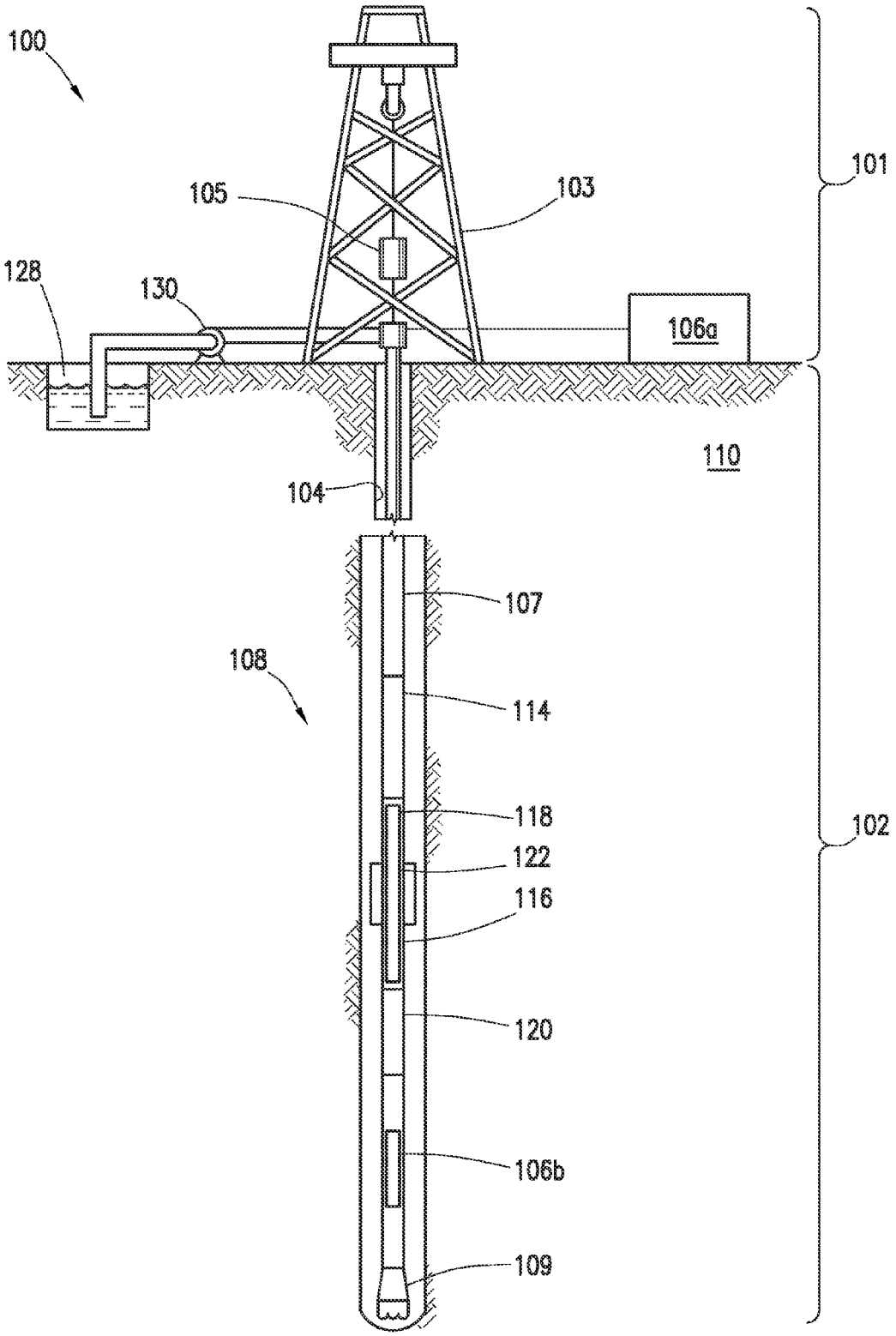
FIG. 1 depicts schematic views, partially in cross-section of a wellsite having surface equipment and a downhole equipment, the downhole equipment including a downhole activation assembly and a downhole tool.

FIG. 1 depicts a schematic view, partially in cross-section, of a wellsite 100. While a land-based drilling rig with a specific configuration is depicted, the present disclosure may involve a variety of land based or offshore applications. The wellsite 100 includes surface equipment 101 and downhole equipment 102. The surface equipment 101 includes a rig 103 positionable at a wellbore 104 for performing various wellbore operations, such as drilling.

Various rig equipment 105, such as a Kelly, rotary table, top drive, elevator, etc., may be provided at the rig 103 to operate the downhole equipment 102. A surface controller 106*a* is also provided at the surface to operate the drilling equipment.

The downhole equipment 102 includes a conveyance, such as drill string 107, with a bottom hole assembly (BHA) (or downhole tool) 108 and a drill bit 109 at an end thereof. The downhole equipment 102 is advanced into a subterranean formation 110 to form the wellbore 104. The drill string 107 may include drill pipe, drill collars, coiled tubing or other tubing used in drilling operations. Downhole equipment, such as the BHA 108, is deployed from the surface and into a wellbore 104 by the drill string 107 to perform downhole operations.

The BHA 108 is at a lower end of the drill string 107 and contains various downhole equipment for performing downhole operations. As shown, the BHA 108 includes stabilizers 114, a reamer 116, an activation assembly 118, a measurement while drilling tool 120, cutter blocks (or blades) 122 (e.g., of a reamer), and a downhole controller 106*b*. While the downhole equipment is depicted as having a reamer 116 for use with the activation assembly 118, a variety of downhole tools may be activated by the activation assembly 118. The downhole equipment may also include various other equipment, such as logging while drilling, telemetry, processors and/or other downhole tools.

The stabilizers 114 may be conventional stabilizers positionable about an outer surface of the BHA 108. The reamer 116 may be an expandable reamer with extendable blades as will be described further herein. The activation assembly 118 may be integral with or operatively coupled to the reamer 116 or other downhole tools for activation therein as will be described further herein. The downhole controller 106*b* provides communication between the BHA 108 and the surface controller 106*a* for the passage of power, data and/or other signals. One or more controllers 106*a,b* may be provided about the wellsite 100.

A mud pit 128 may be provided as part of the surface equipment for passing mud from the surface equipment 101 and through the downhole equipment 102, the BHA 108 and the bit 109 as indicated by the arrows. Various flow devices, such as pump 130 may be used to manipulate the flow of mud about the wellsite 100. Various tools in the BHA 108, such as the reamer 116 and the activation assembly 118, may be activated by fluid flow from the mud pit 128 and through the drill string 107.

Figure 2:
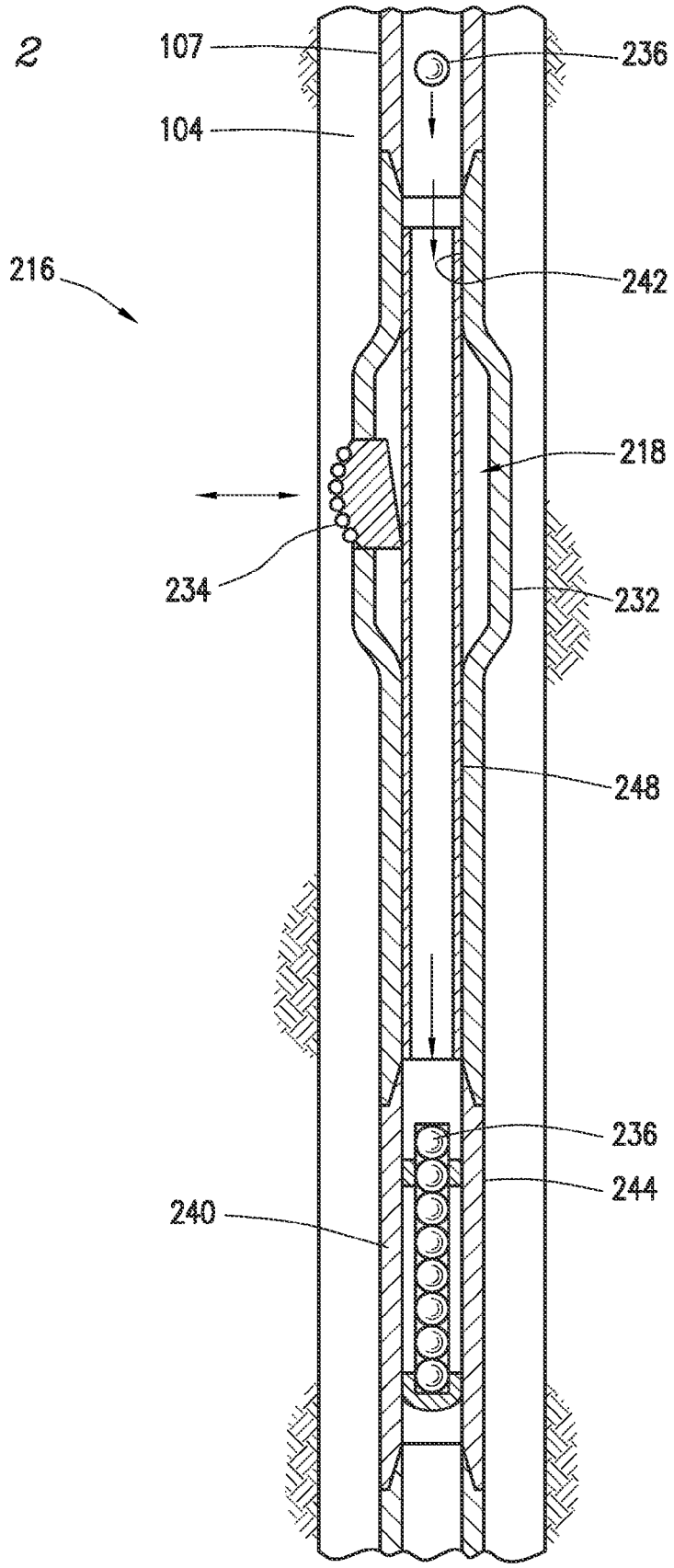
FIG. 2 depicts a longitudinal, partial cross-sectional view of a portion of a downhole tool with a downhole activation assembly.

FIG. 2 shows an example downhole tool 216 with an activation assembly 218 deployed into the wellbore 104 by drill string 107. As shown in this view, the downhole tool 216 is a reamer 216 with the activation assembly 218 therein, but any downhole tool may be employed. The reamer 216 includes a drill collar (or mandrel) 232 with one or more blades 234 extendable therefrom as indicated by the bi-directional arrow. The blade 234 is extendable by activation of the activation assembly 218.

The activation assembly 218 includes one or more balls 236, a sleeve 248, and a ball storage sub 240. The sleeve 248 is slidably positionable in the drill collar 232 and has a flow channel 242 therein for activation by the flow of mud or other fluid therethrough. The ball storage sub 240 is located below the sleeve 248 to catch the balls 236 after they pass through the sleeve 248.

The sleeve 248 of the activation assembly 218 is depicted as being in the same drill collar 232 with the reamer 216. The ball storage sub 240 is depicted as being in another drill collar 244. One or more drill collars may be used. Part or all of the activation assembly 218 may be in the same or a separate drill collar from the reamer 216. One or more ball storage subs 240 may be provided in a desired size and/or shape to receive as many balls 236 as desired.

Figure 3A:
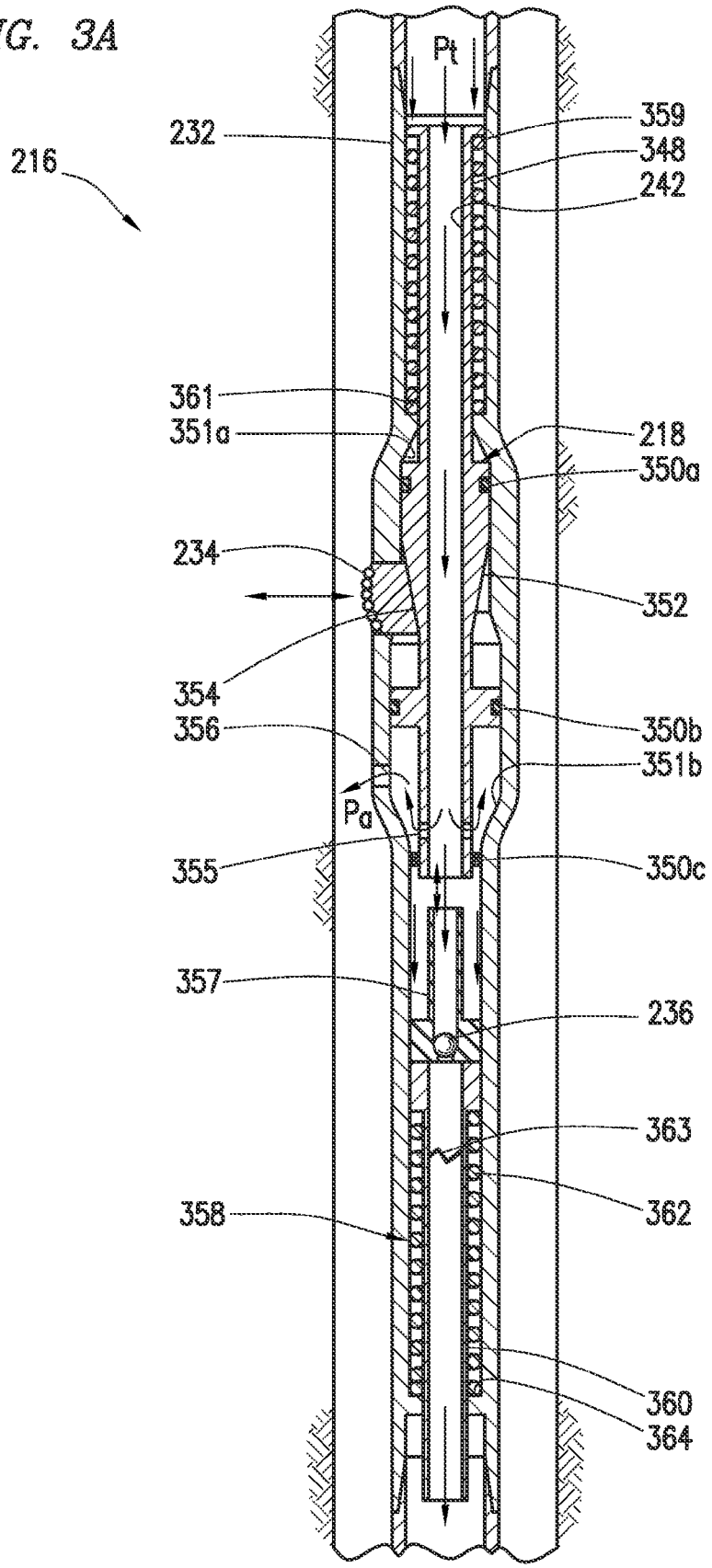
FIGS. 3A-3B depict longitudinal, cross-sectional views of the downhole tool of FIG. 2 in greater detail with the activation assembly in a de-activated and activated position, respectively.

FIGS. 3A-4B depict various aspects of the reamer 216 and the activation assembly 218 of FIG. 2 in greater detail. As shown in these figures, the activation assembly 218 is driven by the flow of fluid therethrough and engageable with the blade 234 of the reamer 216 for selective extension and retraction of the blade 234. FIG. 3A shows the activation assembly 218 in the de-activated position and the blade 234 of the reamer 216 in the retracted position within drill collar 232. FIG. 3B shows the activation assembly 218 in the activated position and the blade 234 of the reamer 216 in the extended position from the drill collar 232. A ball 236 is also disposable through the channel 242 and positionable in ball storage sub 240 to facilitate the activation or de-activation of the activation assembly 218.

Figure 3B:
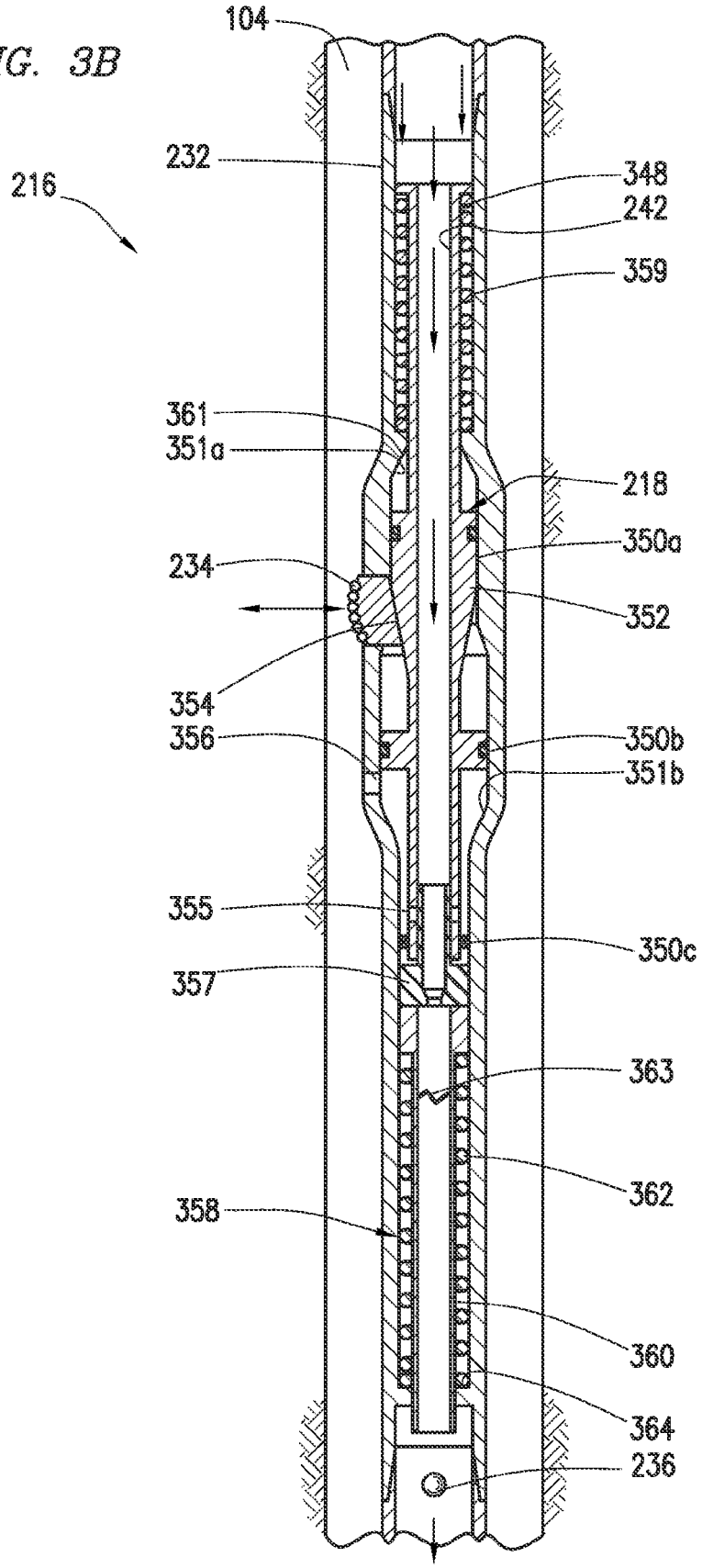

As shown in FIGS. 3A and 3B, the activation assembly 218 includes the ball 236, a sleeve 348, a ball catcher 357, and an indexer 358. The sleeve 348 is slidably positionable in the drill collar 232 as indicated by the bi-directional arrow. The sleeve 348 has the channel 242 therethrough for the passage of mud. The sleeve 348 also has a spring 359 thereabout for urging the sleeve 348 to the uphole position of FIG. 3A. Shoulder 361 is provided in drill collar 232 for supporting the spring 359 about the uphole end of the sleeve 348.

In the de-activated position of FIG. 3A, the activation assembly 218 is in an uphole position such that the blade 234 is in a retracted position within drill collar 232. In the activated position of FIG. 3B, the force of spring 359 is overcome and the activation assembly 218 is moved to a downhole position such that the blade 234 is in an extended position adjacent through the drill collar 232 and adjacent the wall of the wellbore. In this position, the sleeve 348 is pushed against the ball catcher 357 which pushes the indexer 358 and moves the indexer 358 between engaged and dis-engaged positions.

The sleeve 348 has various seals 350*a-c* along an outer surface thereof. One or more seals may be provided to restrict the passage of fluid about the sleeve 348 as it is positioned along the drill collar 232. Fluid passes from the surface and into the drill collar 232 as indicated by the downward arrows. Fluid is permitted to pass between the sleeve 348 and the drill collar 232.

Seal 350*a* is positioned a distance downhole from an uphole end of the sleeve 348 to prevent fluid from extending downhole therefrom. Fluid above seal 350*a* is at a tool pressure ($P_t$) within the drill collar 232 and from the surface. Seal 350*a* provides sealing engagement between the sleeve 348 and the drill collar 232. An open chamber 351*a* is defined between sleeve 348 and drill collar 232 uphole from seal 350*a*. Seal 350*a* prevents fluid in chamber 351*a* from extending downhole therefrom.

The sleeve 348 has a tapered outer surface 352 extending downhole from seal 350*a*. The outer surface 352 is matingly engageable with a correspondingly tapered blade surface 354 of the blade 234. As the sleeve 348 moves to the downhole engaged position, the tapered outer surface 352 drives the blade 234 outwardly to an extended position as shown in FIG. 3B.

Seal 350*b* is positioned along the outer surface of the sleeve 348 a distance downhole from the tapered outer surface 352. Blade 234 is positioned between seals 350*a* and 350*b*. A chamber 351*b* is defined between sleeve 348, drill collar 232 and seal 350*b*. The seal 350*b* isolates chamber 351*b* from fluid uphole therefrom.

Seal 350*c* is positioned a distance downhole from the seal 350*b* for isolating the chamber 351*b*. Seal 350*c* isolates the chamber 351*b* about a downhole end of the sleeve 348 and the drill collar 232. An inlet 355 extends through the sleeve 348 near a downhole end thereof for providing selective fluid communication between chamber 351*b* and the channel 242. In the uphole position of FIG. 3A, the inlet 355 permits fluid to pass between the chamber 351*b* and the channel 242. In the downhole position of FIG. 3B, the inlet is positioned adjacent drill collar 232 and is blocked from allowing fluid to pass between the chamber 351*b* and the channel 242. In this position, the sleeve 348 is shifted downhole such that a downhole end of the sleeve 348 engages the ball catcher 357.

A nozzle 356 extends through drill collar 232 and provides fluid communication between chamber 351*b* and the wellbore 104. Nozzle 356 permits fluid inside the wellbore 104 to equalize to the wellbore pressure when the sleeve 348 is in the de-activated position of FIG. 3A. In this position, fluid passing through the reamer 216 and sleeve 348 is permitted to enter chamber 351*b* and equalize to an annular pressure ($P_a$) in the wellbore 104. Nozzles, valves, regulators or other fluid control devices may be positioned about the activation assembly 218 to selectively control fluid flow and, thereby activation.

The ball catcher 357 selectively engages the indexer 358 for activation thereof. The indexer 358 includes an index tube 360 with a spring 362 thereabout. Examples of indexers that may be used are provided in U.S. Patent/Application No. 20100252276 and/or the FLOW ACTIVATED HYDRAULIC JETTING INDEXING TOOL™ commercially available at www.nov.com. The index tube 360 is slidably movable within the drill collar 362 and activatable similar to the movement of a ball point pen.

The index tube 360 may include two portions with cam surfaces 363 therebetween to provide for an activated position and a de-activated position of the indexer 358. The cam surfaces 363 have a profile to provide for movement of an uphole portion of the index tube 360 between an uphole and a downhole position as the indexer is contacted by the ball catcher 357. The indexer 358 may be switched between positions by engagement of the indexer 358 by the ball catcher 357.

Spring 362 is supported between an uphole end of the index tube 360 and a shoulder 364 downhole therefrom. The weight of the ball 236 and/or the ball catcher 357 onto the indexer 358 may be used to activate the indexer 358. As the indexer 358 is pressed downhole by ball 236, the force of spring 362 is overcome and the index tube 360 is driven to the downhole, activated position against shoulder 364. The indexer 358 may be movable between one or more positions by selective movement of the index tube 360.

The passage of fluid through the sleeve 348 may be manipulated during operation. As shown in FIG. 3A, fluid is permitted to pass through the channel 242 of the sleeve 348 and into ball catcher 357. Ball 236 may be deployed through the channel 242 and into the ball catcher 357 to block flow from passing downhole therefrom. In this position, the ball 236 resists the flow of fluid downhole therefrom, and fluid is diverted out nozzle 356. Fluid is also diverted between the ball catcher 357 and the indexer 358 for diverting fluid around ball 236 and out the indexer 358.

As shown in FIG. 3B, the ball 236 has fallen past the ball catcher 357 and the indexer 358. Fluid is, therefore, permitted to pass through the ball catcher 357 and indexer 358 without requiring diversion outside thereof. The sleeve 348 is driven downhole by the flow of fluid into chamber 351*a* and engages the ball catcher 357. The reamer blade 234 moves to the extended position by downward movement of the tapered surface 352 of sleeve 348 and engagement with tapered surface 354 of blade 234.

Figure 4A:
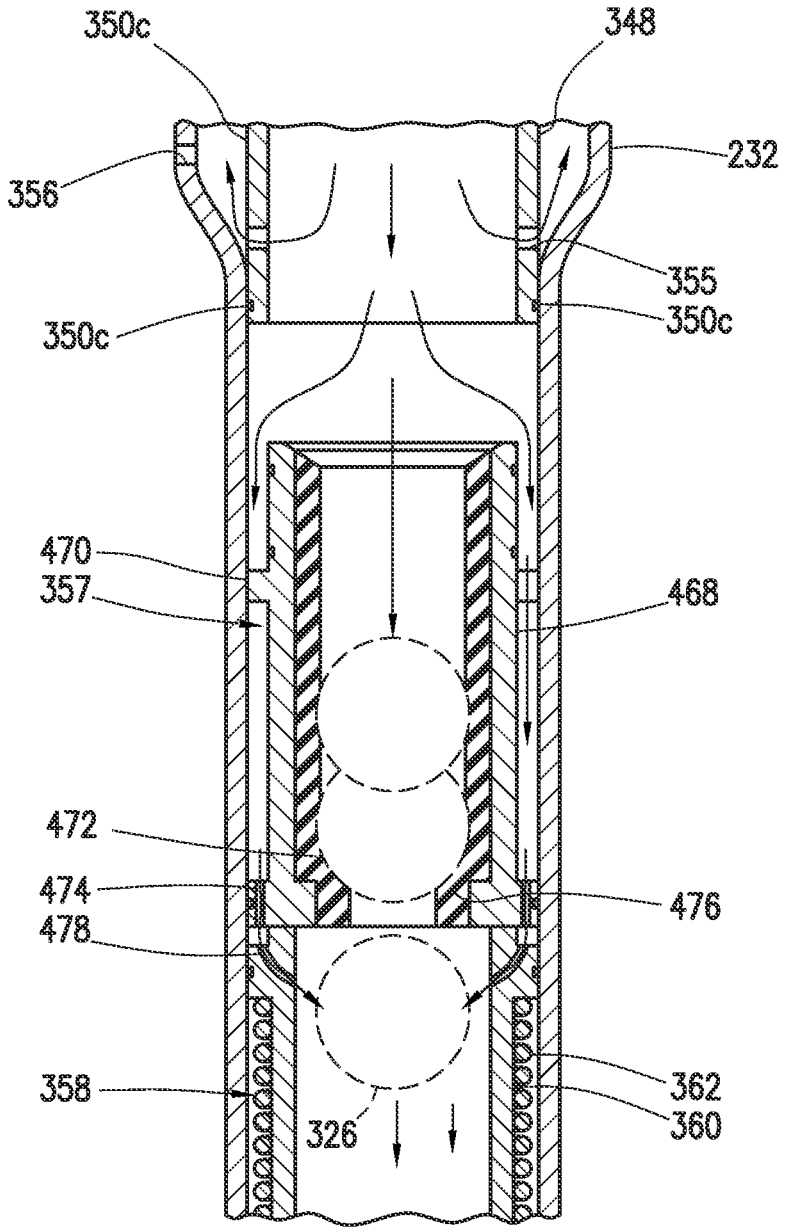
FIGS. 4A-4B depict longitudinal, cross-sectional views of a portion of the downhole drilling assembly of FIG. 2 depicting operation thereof.
Figure 4B:
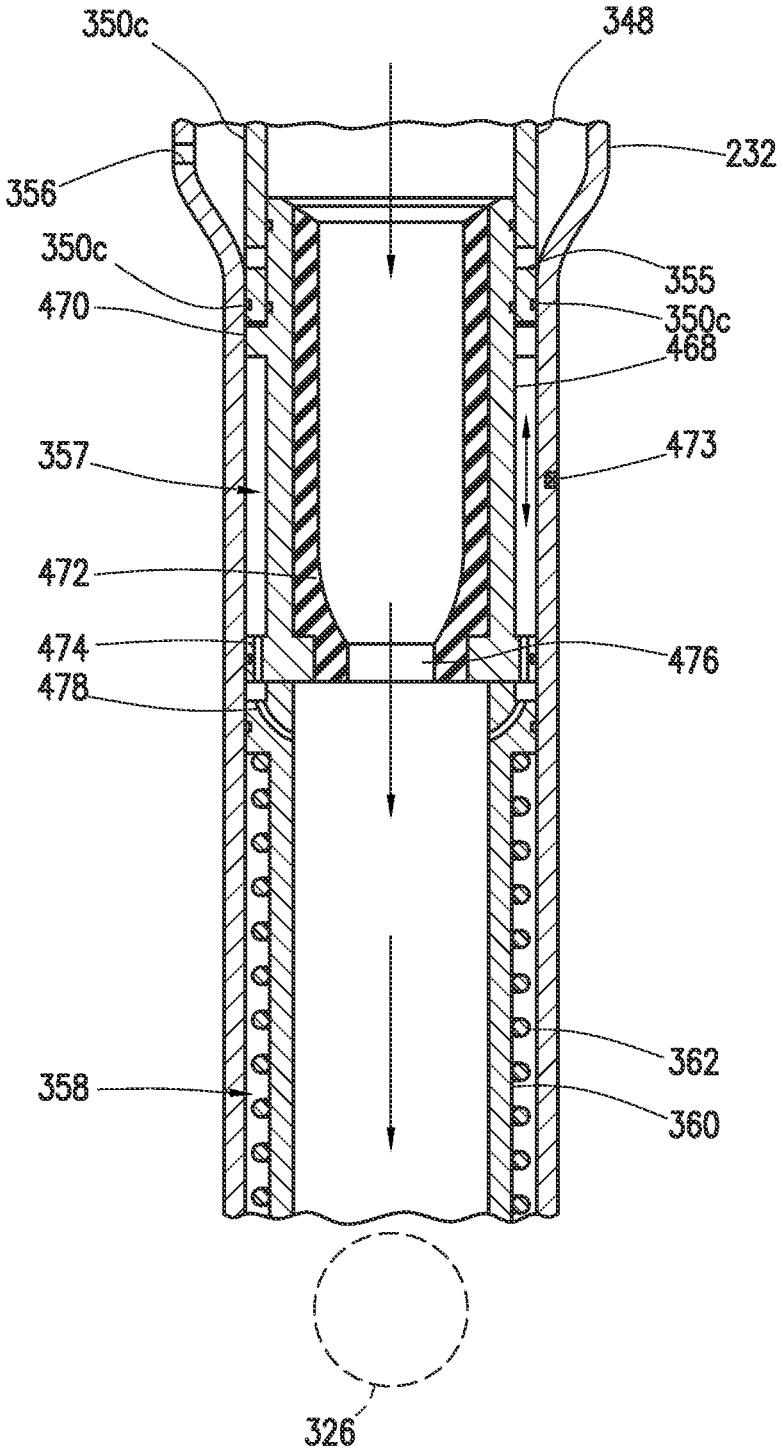

FIGS. 4A and 4B show the flow path of the sleeve 348, ball catcher 357 and indexer 358 in greater detail. As shown in these figures, fluid is diverted through the activation assembly 218 depending on the position of the sleeve 348, ball catcher 357 and indexer 358. As shown in these figures, the sleeve 348 has inlets 355 near a downhole end thereof for passing fluid through the sleeve 348. Seal 350*c* is positionable about the downhole end of the sleeve 348 and the uphole end of the ball catcher 357 to prevent fluid passage therebetween.

The downhole end of the sleeve 348 receivingly engages an uphole end of the ball catcher 357 for sliding engagement therebetween. The ball catcher 357 has a tubular body 468 slidably positionable in the drill collar 232. A shoulder 470 extends from an outer surface of the tubular body 468, and acts as a stop for the sleeve 348. The shoulder 470 may also act as a centralizer about the tubular body 468. A downhole end of the ball catcher 357 abuttingly engages the indexer 358.

The ball catcher 357 also includes a liner 472 and a fluid path 474. The liner 472 is positionable along an inner surface of the tubular body 468. Fluid path 474 is positioned in a downhole end of the ball catcher 357 along an outer surface thereof. A corresponding channel 478 is positioned on an uphole end of the tube 360 of indexer 358. Fluid paths 474 and channel 478 are alignable for passing fluid therethrough.

The liner 472 may be a material, such as an elastomeric material (e.g., rubber), for frictionally engaging the ball 326 as it passes therethrough. The liner 472 may be tapered along the inner surface such that an inner diameter of the tubular body 468 decreases toward the downhole end thereof. The liner 472 may be thicker towards a downhole end of the tubular body 468. The thicker downhole end defines a choke 476 configured to catch the ball 326 as it enters the ball catcher 357. The ball 326 may be grippingly engaged by the ball catcher 357 and stopped therein along choke 376.

Fluid pressure behind the ball 326 increases until the friction between the ball 326 and the liner 472 is overcome and the ball 326 falls therethrough. Fluid flow may be manipulated to allow the ball 326 to be selectively retained or released from the ball catcher 357 as shown in FIG. 4B. The liner 472 and/or the ball 326 may be provided with material, such as rubber, to enhance or reduce frictional engagement as needed. Various balls 326 may be employed with various sizes, materials and/or shapes to affect the resistance through choke 476. The ball 326 may be pushed through the choke 476 by increased fluid pressure sufficient to overcome the frictional engagement of the ball 326 with the liner 472. Fluid pressure may be created, for example, by flow from fluid passed from the surface through the activation assembly 218.

As shown in FIG. 4B, a sensor 473 is positioned in drill collar 232. One or more sensors 473 may be positioned about the activation assembly 218 for determining the position of the sleeve 248. The sensor 473 may be placed in communication with the controllers 106*a,b* (FIG. 1) or other locations as desired.

Referring to FIGS. 2-4B, in operation, the drill string 107 with reamer 216 and activation assembly 218 is deployed into the wellbore with the blade 234 in the retracted position. The ball 236 is deployed through the sleeve 348 with the activation assembly in the de-activated position as shown in FIGS. 3A and 4A. The ball 326 is retained in the choke 476 and activates indexer 358 upon receipt. In this position, fluid flows freely through the sleeve 348 and out the nozzle 356 such that the pressure remains at annular pressure ($P_a$). Fluid pressure is also applied to the sleeve 348 along seal 350*b* and urges the sleeve to the uphole and de-activated position. Fluid also passes around an exterior of the tubular body 468 of the ball catcher 357 and through the indexer 358 via fluid path 474 and channels 478. Fluid is, therefore, able to divert past the ball 326 until the ball 326 is able to fall through the activation assembly as shown in FIG. 4A. As also shown in FIG. 4B, the ball 326 eventually overcomes frictional forces between the ball 326 and liner 472 and passes through choke 476.

As shown in FIGS. 3B and 4B, the ball 326 may eventually be released from the ball catcher 357. Fluid may then flow freely through the ball catcher 357 and indexer 358 without diversion. Fluid also flows between an uphole end of the drill collar 232 and the sleeve 348 and applies pressure to urge the sleeve 348 to the downhole and activated position. The tapered outer surface 352 of sleeve 348 engages the tapered surface 354 of blade 234 and shifts the blade to an extended position. In this position, as the sleeve 348 engages the ball catcher 357, the ball catcher 357 presses the indexer 358 to a downhole, activated position.

Figure 5:
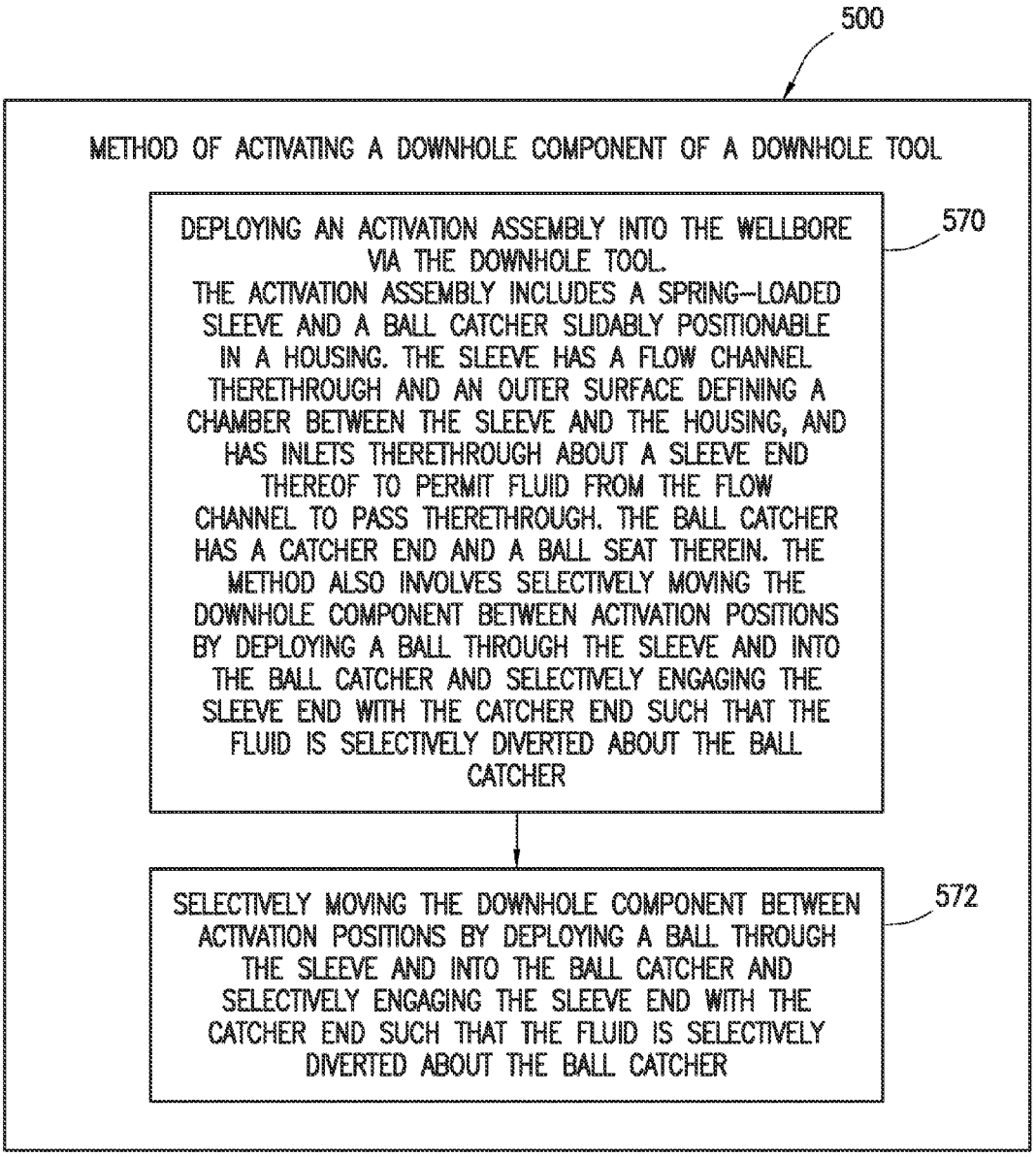
FIG. 5 depicts a method of activating a downhole component.

FIG. 5 depicts a method 500 of activating a downhole component of a downhole tool positionable in a wellbore penetrating a subterranean formation. The method 500 involves 570 deploying an activation assembly into the wellbore via the downhole tool. The activation assembly includes a spring-loaded sleeve and a ball catcher slidably positionable in a housing. The sleeve has a flow channel therethrough and an outer surface defining a chamber between the sleeve and the housing, and has inlets therethrough about a sleeve end thereof to permit fluid from the flow channel to pass therethrough. The ball catcher has a catcher end and a ball seat therein. The method also involves selectively moving the downhole component between activation positions by deploying a ball through the sleeve and into the ball catcher and selectively engaging the sleeve end with the catcher end such that the fluid is selectively diverted about the ball catcher.

The method 500 also involves 572 selectively moving the downhole component between activation positions by deploying a ball through the sleeve and into the ball catcher and selectively engaging the sleeve end with the catcher end such that the fluid is selectively diverted about the ball catcher. The selectively moving may involve diverting fluid through the ball catcher when the ball is unseated therein and/or diverting fluid between the ball catcher and the housing when the ball is seated therein. The method may also involve passing the fluid through paths in the ball catcher and channels in the downhole component and/or passing the fluid from the flow channel to the chamber via the inlets.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more drilling force assemblies may be provided with one or more features of the various drilling assemblies herein and connected about the drilling system.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole activation assembly for activating a downhole component of a downhole tool positionable in a wellbore penetrating a subterranean formation, the activation assembly comprising:

a housing operatively connectable to the downhole tool;

a spring-loaded sleeve slidably positionable in the housing, the sleeve having a flow channel therethrough and an outer surface defining a chamber between the sleeve and the housing, the chamber divided into an upper variable volume chamber and a lower variable volume chamber, the upper and lower variable volume chambers in fluid isolation from each other, the sleeve having therethrough about a sleeve end thereof to permit fluid from the flow channel to pass therethrough; and a ball catcher slidably positionable in the housing, the ball catcher having a catcher end engageable with the sleeve end to selectively divert the fluid thereabout and a ball seat therein to receivingly engage a ball passing through the sleeve whereby the ball catcher selectively moves the downhole component between activation positions.

2. The activation assembly of claim 1, wherein the sleeve and the ball catcher are positionable to prevent fluid flow between the flow channel and the chamber.

3. The activation assembly of claim 1, wherein the fluid is passed through the ball catcher when the ball is unseated from the ball catcher.

4. The activation assembly of claim 1, wherein the fluid is diverted between the ball catcher and the housing when the ball is seated in the ball catcher.

5. The activation assembly of claim 1, wherein the ball catcher has paths therethrough to permit the fluid to pass from between the housing and the ball catcher to the downhole component.

6. The activation assembly of claim 5, wherein the downhole component has channels to pass the fluid from the paths therethrough.

7. The activation assembly of claim 1, further comprising seals positioned between the sleeve and the housing.

8. The activation assembly of claim 7, wherein the seals comprise an uphole seal at an uphole end, a downhole seal at the sleeve end, and an intermediate seal between the uphole and the downhole seals.

9. The activation assembly of claim 1, further comprising a blade engageable by the outer surface of the sleeve and selectively extendable from the housing thereby.

10. The activation assembly of claim 9, wherein the outer surface is tapered.

11. The activation assembly of claim 1, wherein the ball catcher comprises an elastomeric material along an inner surface thereof engageable with the ball.

12. A downhole tool positionabie n a wellbore penetrating a subterranean formation, the downhole tool comprising:

a conveyance;

a bottom hole assembly deployable into the wellbore by the conveyance, the bottom hole assembly carrying a downhole component;

a downhole activation assembly positionable about the bottom hole assembly, the activation assembly comprising:

a housing operatively connectable to the downhole tool;

a spring-loaded sleeve slidably positionable in the housing, the sleeve having a flow channel therethrough and an outer surface defining a chamber between the sleeve and the housing, the chamber divided into an upper variable volume chamber and a lower variable volume chamber, the upper and lower variable volume chambers in fluid isolation from each other, the sleeve having inlets therethrough about a sleeve end thereof to permit fluid from the flow channel to pass therethrough; and a ball catcher slidably positionable in the housing, the ball catcher having a catcher end engageable with the sleeve end to selectively divert the fluid thereabout and a ball seat therein to receivingly engage a ball passing through the sleeve whereby the ball catcher selectively moves the downhole component between activation positions.

13. The downhole tool of claim 12, wherein the downhole component is an indexer.

14. The downhole tool of claim 12, further comprising reamer with a blade, the sleeve engageable with the blade whereby the blade is selectively extendable therefrom.

15. The downhole tool of claim 12, further comprising a controller.

16. A method of activating a downhole component of a downhole tool positionable in a wellbore penetrating a subterranean formation, the method comprising:

deploying an activation assembly into the wellbore via the downhole tool, the activation assembly comprising a spring-loaded sleeve and a ball catcher slidably positionable in a housing, the sleeve having a flow channel therethrough and an outer surface defining a chamber between the sleeve and the housing, the chamber divided into an upper variable volume chamber and a lower variable volume chamber, the upper and lower variable volume chambers in fluid isolation from each other, the sleeve having inlets therethrough about a sleeve end thereof to permit fluid from the flow channel to pass therethrough, the ball catcher having a catcher end and a ball seat therein; and selectively moving the downhole component between activation positions by deploying a ball through the sleeve and into the ball catcher and selectively engaging the sleeve end with the catcher end such that the fluid is selectively diverted about the ball catcher.

17. The method of claim 16, wherein the selectively moving comprises diverting fluid through the ball catcher when the ball is unseated therein.

18. The method of claim 16, wherein the selectively moving comprises diverting fluid between the ball catcher and the housing when the bail is seated therein.

19. The method of claim 18, further comprising passing the fluid through paths in the ball catcher and channels in the downhole component.

20. The method of claim 16, further comprising passing the fluid from the flow channel to the chamber via the inlets.

* * * * *